US011369135B2

(12) United States Patent
Gamberini et al.

(10) Patent No.: US 11,369,135 B2
(45) Date of Patent: Jun. 28, 2022

(54) DEVICE AND METHOD FOR ROLLING CIGARETTES, FILTER CIGARETTES OR FILTERS

(71) Applicant: G.D S.P.A., Bologna (IT)

(72) Inventors: Giuliano Gamberini, Crevalcore (IT); Massimo Malavolta, Ferrara (IT); Massimo Sartoni, Bologna (IT)

(73) Assignee: G.D S.P.A., Bologna (IT)

( * ) Notice: Subject to any disclaimer, the term of this patent is extended or adjusted under 35 U.S.C. 154(b) by 351 days.

(21) Appl. No.: 16/078,092

(22) PCT Filed: Mar. 7, 2017

(86) PCT No.: PCT/IB2017/051333
§ 371 (c)(1),
(2) Date: Aug. 21, 2018

(87) PCT Pub. No.: WO2017/153915
PCT Pub. Date: Sep. 14, 2017

(65) Prior Publication Data

US 2019/0053534 A1 Feb. 21, 2019

(30) Foreign Application Priority Data

Mar. 10, 2016 (IT) ..... IT102016000024574

(51) Int. Cl.
*A24C 5/47* (2006.01)
*A24C 5/10* (2006.01)
*A24C 5/32* (2006.01)

(52) U.S. Cl.
CPC ..... *A24C 5/471* (2013.01); *A24C 5/10* (2013.01); *A24C 5/327* (2013.01); *A24C 5/475* (2013.01)

(58) Field of Classification Search
None
See application file for complete search history.

(56) References Cited

U.S. PATENT DOCUMENTS

2001/0032651 A1 10/2001 Dombek
2002/0129823 A1 9/2002 Dombek et al.
2016/0157518 A1* 6/2016 Emmet ..... A24C 5/47 131/58

FOREIGN PATENT DOCUMENTS

CN 1319358 C 10/2001
CN 1750766 A 3/2006
(Continued)

OTHER PUBLICATIONS

International Search Report and Written Opinion dated Jun. 21, 2017 for counterpart PCT Application No. PCT/IB2017/051333.
(Continued)

*Primary Examiner* — Michael J Felton
*Assistant Examiner* — Katherine A Will
(74) *Attorney, Agent, or Firm* — Shuttleworth & Ingersoll, PLC; Timothy Klima

(57) ABSTRACT

A device for rolling cigarettes, filter cigarettes or filters, including a rolling channel delimited, at one end, by a rolling portion of a feed conveyor, and at the other end, by a rolling unit which includes an infeed rolling bed and an outfeed rolling bed located in succession along the travelling direction of the rolling channel and defining an infeed stretch and an outfeed stretch of the rolling channel, respectively. The infeed rolling bed is movable along the travelling direction independently of the outfeed rolling bed to produce different rolling modes along the infeed stretch and along the outfeed stretch.

20 Claims, 8 Drawing Sheets

(56) References Cited

FOREIGN PATENT DOCUMENTS

| | | | |
|---|---|---|---|
| CN | 103653239 | A | 3/2014 |
| CN | 103889255 | A | 6/2014 |
| EP | 1121871 | A2 | 8/2001 |
| EP | 1240834 | A2 | 9/2002 |
| EP | 2545791 | A1 | 1/2013 |
| GB | 872047 | A | 7/1961 |
| GB | 2078090 | A | 1/1982 |
| JP | 2001231534 | A | 8/2001 |
| WO | WO2004073426 | A1 | 2/2004 |

OTHER PUBLICATIONS

Chinese Office Action dated Aug. 31, 2020 from counterpart Chinese Patent Application No. CN201780013291.X.
Japanese Office Action dated Mar. 2, 2021 from counterpart Japanese Patent Application No. 2018-547885.
Korean Office Action dated Oct. 14, from counterpart Korean Patent Application No. 2018-7025926.

* cited by examiner

DEVICE AND METHOD FOR ROLLING CIGARETTES, FILTER CIGARETTES OR FILTERS

This application is the National Phase of International Application PCT/IB2017/051333 filed Mar. 7, 2017 which designated the U.S.

This application claims priority to Italian Patent Application No. 102016000024574 filed Mar. 10, 2016, which application is incorporated by reference herein.

TECHNICAL FIELD

This invention relates to a device and method for rolling cigarettes, filter cigarettes or filters.

BACKGROUND ART in filter-tip attachment machines, the term "rolling" means an operating step whereby each filterless cigarette, hereinafter referred to as "piece of cigarette" is joined to a respective piece of filter by means of a patch of paper to which glue has previously been applied by a gluing unit. Generally speaking, the term "rolling" can be used with reference to cigarettes, filter cigarettes, filters or smokers' articles in general, including electric/electronic or multi-component ones.

More specifically, rolling in the filter tip attachment machine is performed in a channel where, according to a long-established technique, two filter cigarettes are made at a time. According to this technique, a double piece of filter, that is, a piece of filter plug which is twice as long as the filter tip of the end product, is first of all interposed between two pieces of cigarette. Next, a double patch, that is, a patch which is twice as long as the one on the end product, is rolled and wrapped round the double piece of filter and round the adjacent ends of the pieces of cigarette, to obtain a semi-finished product consisting of a double cigarette.

After rolling, the double cigarette is cut at the line half way along the double piece of filter so as to obtain two single cigarettes.

As is known, the rolling channel is defined by two facing walls which are movable relative to one another. The height of the rolling channel is slightly smaller than the diameter of the filter-tipped cigarette to be made so that a light compressive, and hence frictional, force is applied to the filters and to the respective pieces of cigarette adjacent thereto, as required to guarantee correct rolling and gluing of the patches.

Usually, one wall is defined by the periphery of a feed drum on which the groups composed of "cigarette piece—double filter piece—cigarette piece" are held by suction in respective flutes; while the other wall is defined by a fixed tile facing the periphery of the conveyor drum. Generally speaking, the fixed tile has, at the entry to the rolling channel, a rotation trigger tooth or projection which allows dislodging the groups from the flutes of the feed drum and sets them in rotation about the respective longitudinal axis.

Instead of the fixed tile, there may be a flexible conveyor, as described, for example, in document WO2004073426, which delimits the entire rolling channel.

The Applicant has observed that, in particular in the case of the fixed tile, the groups of filter and cigarette pieces impact strongly against the rotation trigger tooth (or more in general against the fixed tile) and undergo a very high rotational acceleration because the impact causes each group to pass from zero rotation speed to a speed of rotation about its longitudinal axis which is set by the tangential speed of the feed drum, that is, the production speed of the machine.

The Applicant has also observed that this initial rolling step is particularly critical because impact against the stationary tile can differently affect the pieces of cigarette and filter, which, although connected by a portion of patch glued longitudinally to them, may accelerate at different rates when the rolling step starts, thus twisting and creasing the patch.

DISCLOSURE OF THE INVENTION

This invention therefore has for an aim to provide a device and a method for rolling cigarettes, filter cigarettes or filters to overcome the disadvantages described above with reference to the prior art.

More specifically, the aim of this invention is to provide a device and a method for rolling cigarettes, filter cigarettes or filters capable of guaranteeing high rolling quality independently of the production speed of the machine.

The above aims are achieved by a device and a method for rolling cigarettes, filter cigarettes or filters and having the features set out in one or more of the appended claims.

Advantageously, the Applicant has found that the higher the speed of the machine the greater the creasing, that creasing occurs during the initial stages of rolling and for this reason that by dividing the rolling unit into an infeed rolling bed and an outfeed rolling bed, it is possible to differentiate the rolling modes without changing machine speed. Thanks to a device and method according to this invention, rolling can be divided into an initial step (or infeed step) and a final step (or outfeed step) performed at different speeds.

For example, using a rolling conveyor (movable bed) as infeed rolling bed and, preferably, a fixed tile (fixed bed) as outfeed rolling bed allows preventing the formation of creases during the initial rolling step and simplifying the final rolling step when all the pieces are rotating at the same speed so that the patch can be wrapped around them uniformly.

BRIEF DESCRIPTION OF THE DRAWINGS

Further features and advantages of the invention are more apparent from the following exemplary and therefore non-limiting description of a preferred and hence non-exclusive embodiment of a device and method for rolling cigarettes, filter cigarettes, or filters.

The invention is described below with reference to the accompanying drawings, which illustrate a non-limiting embodiment of it and in which.

DETAILED DESCRIPTION OF PREFERRED EMBODIMENTS OF THE INVENTION

Figure 1:
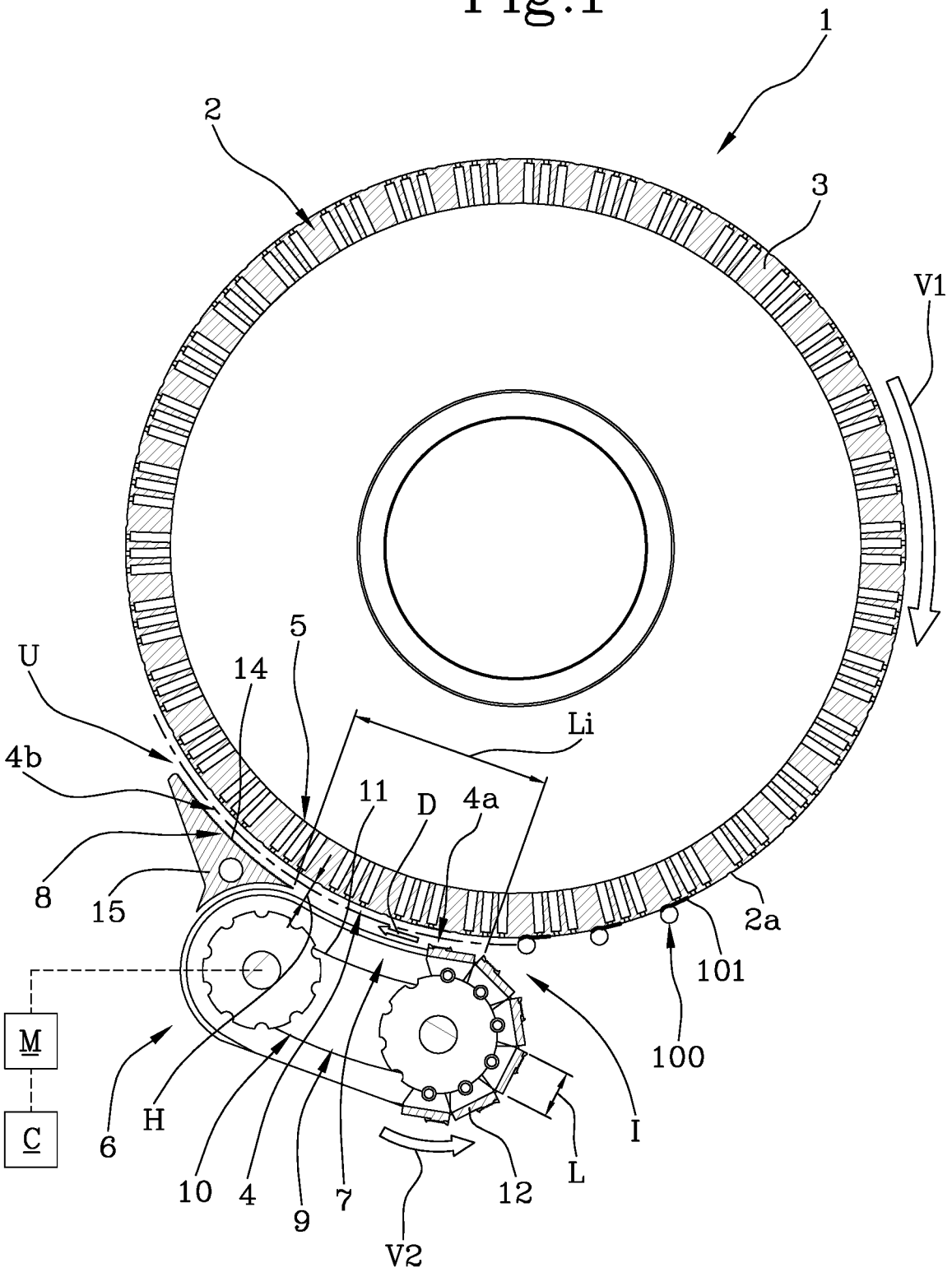
FIG. 1 is a cross-sectional view of a first embodiment of a rolling device according to this invention.

With reference to FIG. 1, the numeral 1 denotes in its entirety a device for rolling cigarettes, filter cigarettes or filters according to the invention.

The device 1 is configured to receive groups 100 of pieces, for example pieces of cigarettes and filters, and to wrap them in respective connecting patches 101. Each group 100 is defined by at least two axially aligned pieces. Applied to each group is a patch which is disposed tangentially to the group starting from one end of it, which is preferably glued to the group. Preferably, to fix the patches 101 to the groups 100, each patch 101 has glue previously spread on it by a gluing unit, not illustrated. Preferably, each patch 101 is applied to the respective group 100 in "flag-like manner". The expression "flag-like manner" means that the patch 101 adheres to the group 100 only by a reduced portion of it, extending for a pre-wrapping angle β, preferably at one edge of it. The rest of the patch 101 remains lifted to prevent the patch 101 from sticking.

For example, in the case of cigarettes, a group 100 may be made up of two axially aligned pieces of cigarette and one double filter, for example of composite type, interposed between the two pieces of cigarette.

The device 1 comprises a feed conveyor 2 configured to feed groups 100 and patches 101 disposed transversely to the direction along which they are fed. Preferably, the feed conveyor 2 transports the groups 100 to which respective connecting patches 101 have been applied as described above.

In the preferred embodiment, the conveyor may be a rotary drum 3 adapted to be set in rotation about its horizontal axis to feed the groups 100 to the rolling channel 4. Preferably, the feed conveyor 2 is a drum 3 provided with suction flutes 2*a* disposed on a radially external surface of the drum itself. Each suction flute 2*a* is configured to receive and retain a group 100 of pieces and the respective patch.

The device 1 comprises a rolling channel 4 configured to roll the patches 101 around the respective groups 100. The channel 4 extends along its main direction of extension between an infeed station "I" of the groups 100 and of the respective patches 101 and an outfeed station "U" of the groups after they have been wrapped, each in a respective patch 101. In the case of cigarettes, at the outfeed of the rolling channel 4, the device 1 produces double cigarettes joined to each other by a patch 101 fully wrapped round a respective group 100.

Transversely to the main direction of extension, the rolling channel 4 is delimited, at one end, by a rolling portion 5 of the feed conveyor 2, and at the other end, by a rolling unit 6 located at a distance or height "H" from the rolling portion 5 such as to define a width of the rolling channel 4 which is approximately the same as, or slightly smaller than, the diameter of the groups 100. The width of the channel 4 is such as to allow each group of pieces to be received lengthways. The width "La" of the channel 4 is represented by way of example in FIG. 5.

The rolling channel 4 is adapted, in a use configuration of the device 1, to be traversed by each group 100 of pieces transversely to the main direction of extension of the channel itself. Each group 100, as it advances between the infeed station "1" and the outfeed station "U" in a travelling direction along the main direction of extension of the channel 4, rotates about its longitudinal axis, rolling on the rolling portion 5 and on the rolling unit 6.

The rolling unit 6 comprises an infeed rolling bed 7 and an outfeed rolling bed 8 located in succession along the travelling direction "D" of the rolling channel 4.

The infeed rolling bed 7 defines an infeed stretch 4*a* of the rolling channel 4. The outfeed rolling bed defines an outfeed stretch 4*b* of the rolling channel 4.

The infeed stretch 4*a* and the outfeed stretch 4*b* are adapted to roll each group 100 of pieces by an infeed rolling angle δ and an outfeed rolling angle (not illustrated), respectively. The infeed rolling angle δ is preferably less than or equal to 360°.

The infeed rolling bed 7 is movable along the travelling direction "D" independently of the outfeed rolling bed 8 to produce different rolling modes along the infeed stretch 4*a* and along the outfeed stretch 4*b*, for example different rolling speeds—meaning by "rolling speed" the velocity (whether angular or linear) attainable by the group about its axis.

Preferably, the infeed rolling bed 7 is a movable bed, while the outfeed bed 8 may be a fixed bed or a movable bed independent of the infeed rolling bed 7 to perform an infeed rolling step at low speed along the infeed stretch 4*a* and an outfeed rolling step at high speed along the outfeed stretch 4*b*. The terms "high" and "low" are used in the relative sense to mean that the rolling speed in the infeed stretch is lower than the rolling speed in the outfeed stretch.

In a possible embodiment, the feed conveyor 2 is configured to feed the groups and move the rolling portion along the travelling direction "D" at a first speed V1. In the case of the rotary drum 3, the groups are fed at a peripheral or tangential speed V1 corresponding to the advancing speed of the rolling portion 5.

In a possible embodiment, the infeed rolling bed 7 is defined by a rolling conveyor 9 which can be moved at a second speed V2 which is lower than the first speed V1 and in the same direction. More specifically, the peripheral speed of the drum 3 is greater than the advancing speed of the rolling conveyor 9 along the channel 4 to allow rolling to be carried out.

The infeed rolling angle δ and the second speed V2, hence the rolling speed along the infeed stretch 4*a* of the channel 4 can be varied as a function of the properties of the group 100 and of the pieces making it up.

In a possible embodiment, for example illustrated in the accompanying drawings, the rolling conveyor 9 comprises at least one flexible endless conveyor element 10 trained around transmission means. The infeed rolling bed 7 is defined at a rolling portion 11 of the flexible conveyor element which faces the rolling portion 5 of the feed conveyor 2.

The flexible conveyor element 10 is operatively connected to motor means "M" to be driven and advanced at the second speed V2.

Preferably, the device 1 comprises a control unit "C" operatively associated with the rolling conveyor 9, preferably with the motor means "M" of the flexible conveyor element 10, if provided, to adjust the second speed V2 as a function of the properties of the group 100 and of the pieces making it up. The control unit "C" is programmable to modify the rolling mode at least along the infeed stretch 4*a* of the channel 4 as a function of the properties of the group 100 and of the pieces making it up.

In the embodiment illustrated in FIG. 1, the rolling conveyor 9 comprises a plurality of pads 12 fixed to one or more flexible conveyor elements 10. When they pass through the rolling portion 11, the pads 12 define the infeed rolling bed 7. Preferably, the flexible conveyor element 10 is made in the form of a chain adapted to receive and drive the pads 12.

With reference to FIGS. 2*a*-2*d*, each pad may comprise a tooth 13 configured to dislodge a group 100 of pieces from a respective flute 2*a* of the feed conveyor 2. The tooth 13 is in the position of an infeed tooth in that it is an element which starts the rotation of the groups as they feed into the channel 4.

In this case, the control unit "C" may be further programmed to control the feed conveyor 2 and the rolling conveyor 9 in such a way that the pads 12 are synchronized with the flutes 2*a* and the pad 12, in particular the tooth 13, if provided, meets the respective group 100 at the infeed station "I".

Each pad 12 may comprise an outfeed tooth 13*a* adapted to improve the coupling with the outfeed bed 8 in order to avoid damaging the group 100 as it passes from the infeed bed 7 to the outfeed bed 8.

Each pad extends along the travelling direction "D" for a rolling length "L" equal to the infeed rolling arc of a group of pieces, corresponding to the infeed rolling angle δ. Each pad is dedicated to the rolling of one group 100 which is preferably carried out in a single pad.

The infeed stretch 4*a* of the rolling channel 4 extends along the travelling direction "D" for an infeed rolling length "Li" which is defined as a function of the first speed V1, the second speed V2 and the infeed rolling angle δ.

In a possible embodiment, illustrated for example in the accompanying drawings, the outfeed rolling bed 8 is a fixed bed defined, for example, by a wall 14 of a tile 15. Preferably, the outfeed bed 8 is heatable.

In the case of a fixed outfeed bed and a movable infeed bed, the outfeed stretch 4*b* of the rolling channel 4 defines a high speed outfeed rolling step, while the infeed stretch 4*a* of the rolling channel 4 defines a low speed infeed rolling step.

Figure 4:
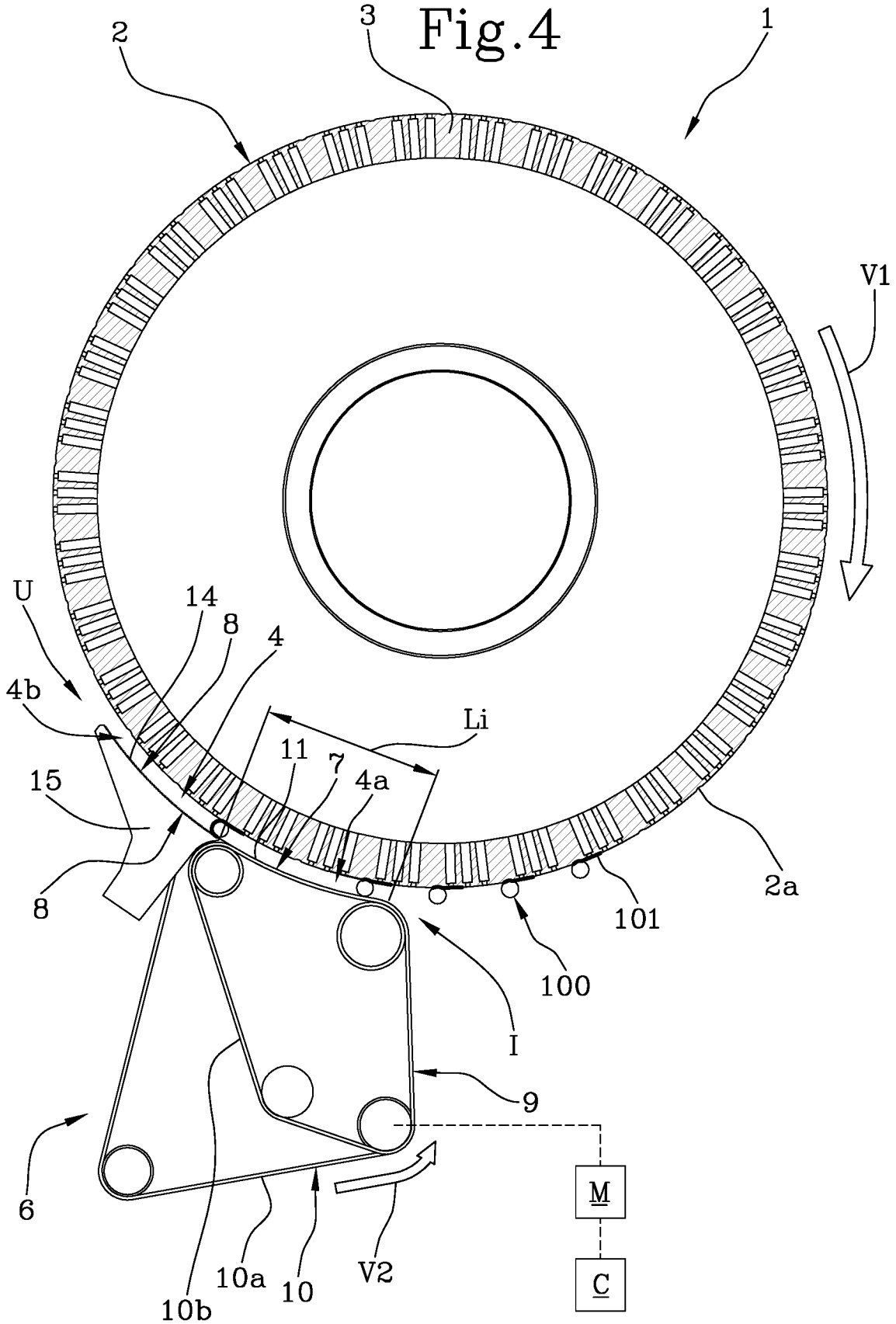
FIG. 4 is a cross-sectional view of a further embodiment of a rolling device according to this invention.

FIG. 4 shows a possible alternative where the rolling conveyor 9 comprises the flexible conveyor element 10 which itself forms the infeed rolling bed 7 when it passes through the rolling portion 11.

The flexible conveyor element 10 may be in the form of an endless belt or tape of resilient, flexible material.

Preferably, the flexible conveyor element 10 comprises three conveyor belts/tapes running side by side transversely to the travelling direction "D". This arrangement means there are two perimeter conveyor belts 10*a* and a central conveyor belt 10*b*. The perimeter conveyor belts 10*a* have a width "L1" which is preferably smaller than the width "L2" of the central conveyor belt. The width of the conveyor belts is measured transversely to the main direction of extension and width of the channel 4, as illustrated for example in FIG. 5.

In a possible embodiment, for example illustrated in the accompanying drawings, the portion of the perimeter conveyor belts 10*a* located at the rolling portion 11 of the flexible conveyor element 10 has a length "L4" which, along the travelling direction "D", is greater than the length "L3" of the portion of the central conveyor belt 10*b* located at the rolling portion 11 of the flexible conveyor element 10.

Figure 5:
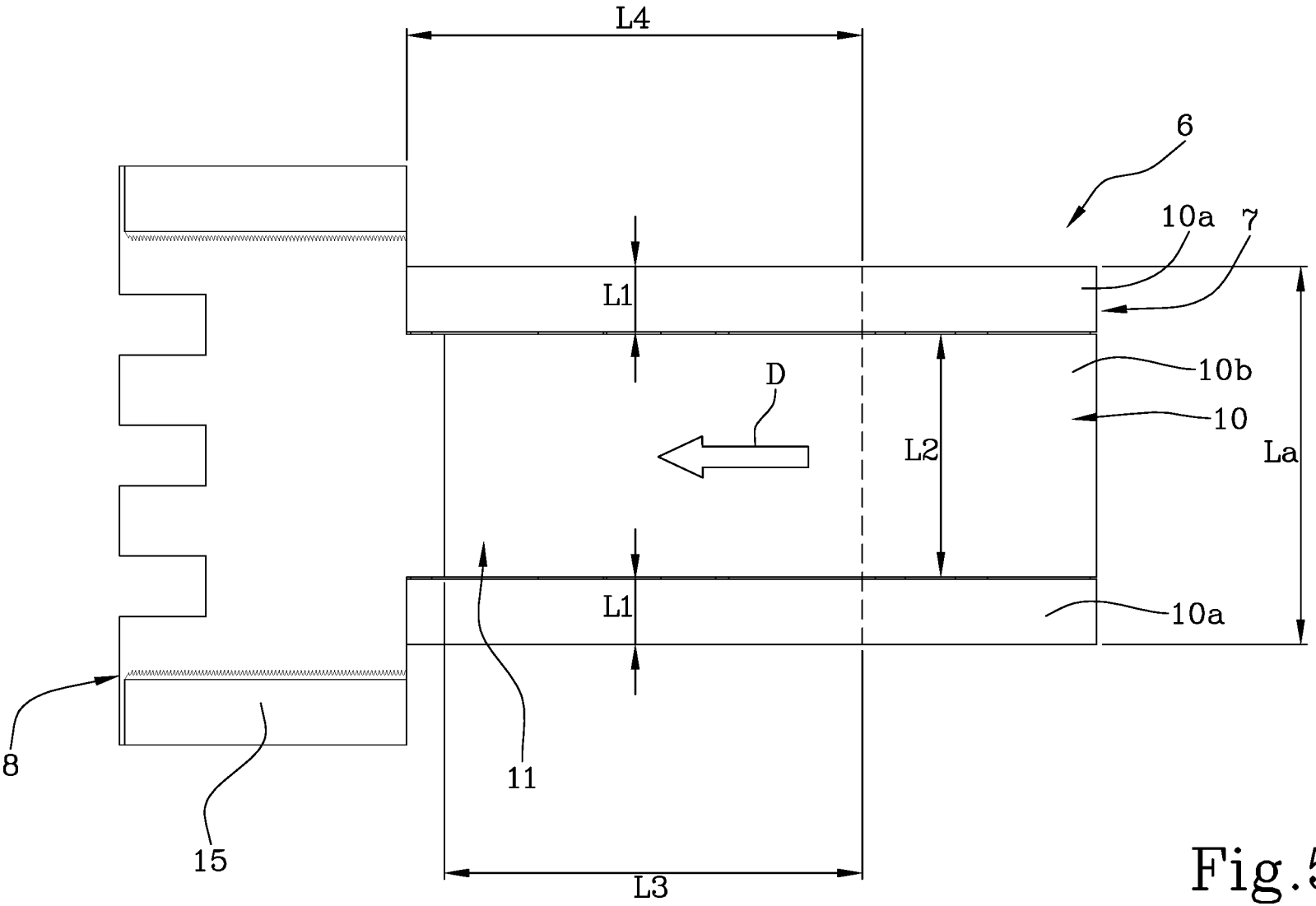
FIG. 5 shows a detail from FIG. 4.

Preferably, the infeed stretch 4*a* and the outfeed stretch 4*b* are interpenetrated at the central conveyor belt 10*b* in passing from the infeed bed 7 to the outfeed bed 8, as illustrated for example in FIG. 5.

FIGS. 2*a*-2*d* schematically represent the operation of the device 1, in particular of the type comprising pads 12.

The feed conveyor 2 retains and feeds each group 100 associated with the respective patch 101 at the speed V1 up to the infeed station "I" of the rolling channel 4. When it enters the rolling channel 4, the patch 101 is preferably disposed in "flag-like" manner and pre-wrapped round the group 100 by a pre-wrapping angle β.

Figure 2A:
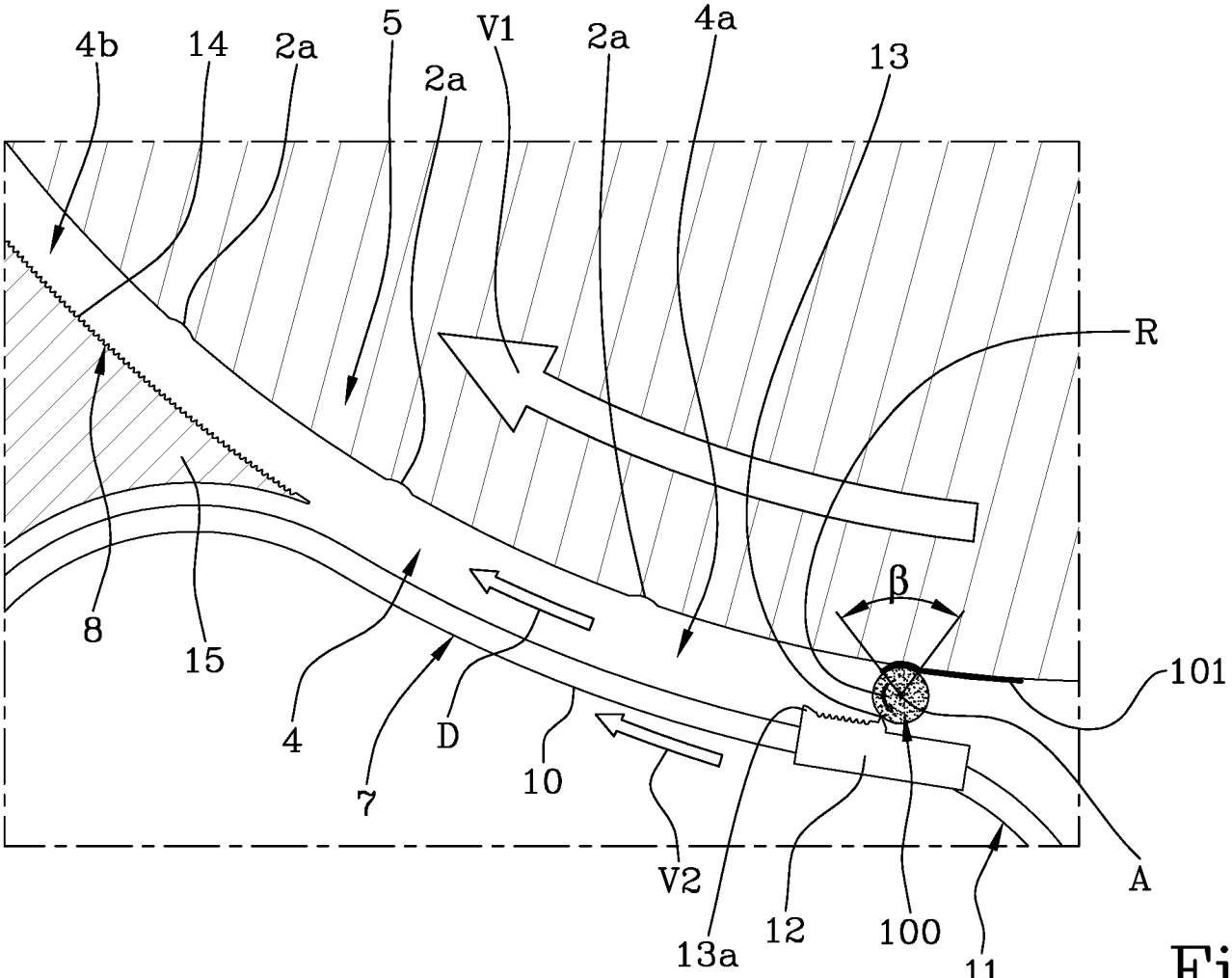
FIGS. 2*a*-2*d* are enlarged details of a portion of the rolling device of FIG. 1, at different moments of a step of the rolling method according to this invention.

FIG. 2*a* illustrates the moment the group 100 meets the pad 12, preferably provided with the tooth 13 which dislodges the group from the respective flute 2*a* and starts the rotation "R" of the group 100 about its longitudinal axis "A". The group 100 then starts rolling on the rolling portion 5 and on the infeed rolling bed 7 as it advances along the channel 4 in the travelling direction "D".

The speed of rotation of the group 100 about its axis depends at least on the first speed V1 and on the second speed V2. In any case, since the infeed bed 7 is movable, the impact and acceleration which the group 100 is subjected to are limited and prevent creases from being formed on the patch.

Figure 2B:
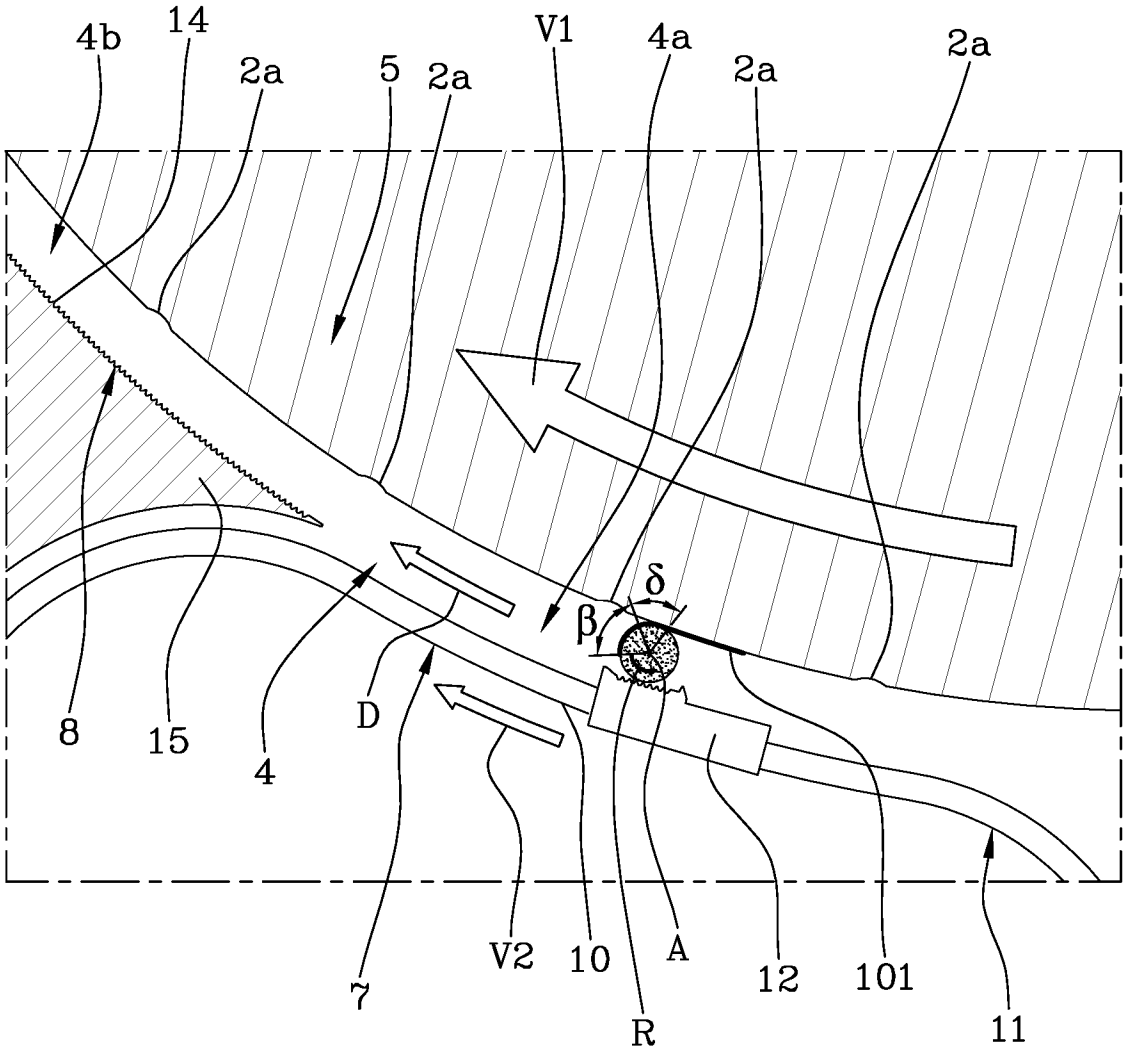

FIG. 2*b* shows an intermediate moment of the infeed rolling step where the group 100 is traversing the rolling channel 4 and, as a result of rolling on the rolling portion 5 and on the infeed bed 7, the group 100 advances relative to the infeed bed 7 and withdraws relative to the rolling portion 5 while the patch 101 is wrapped around the group.

Figure 2C:
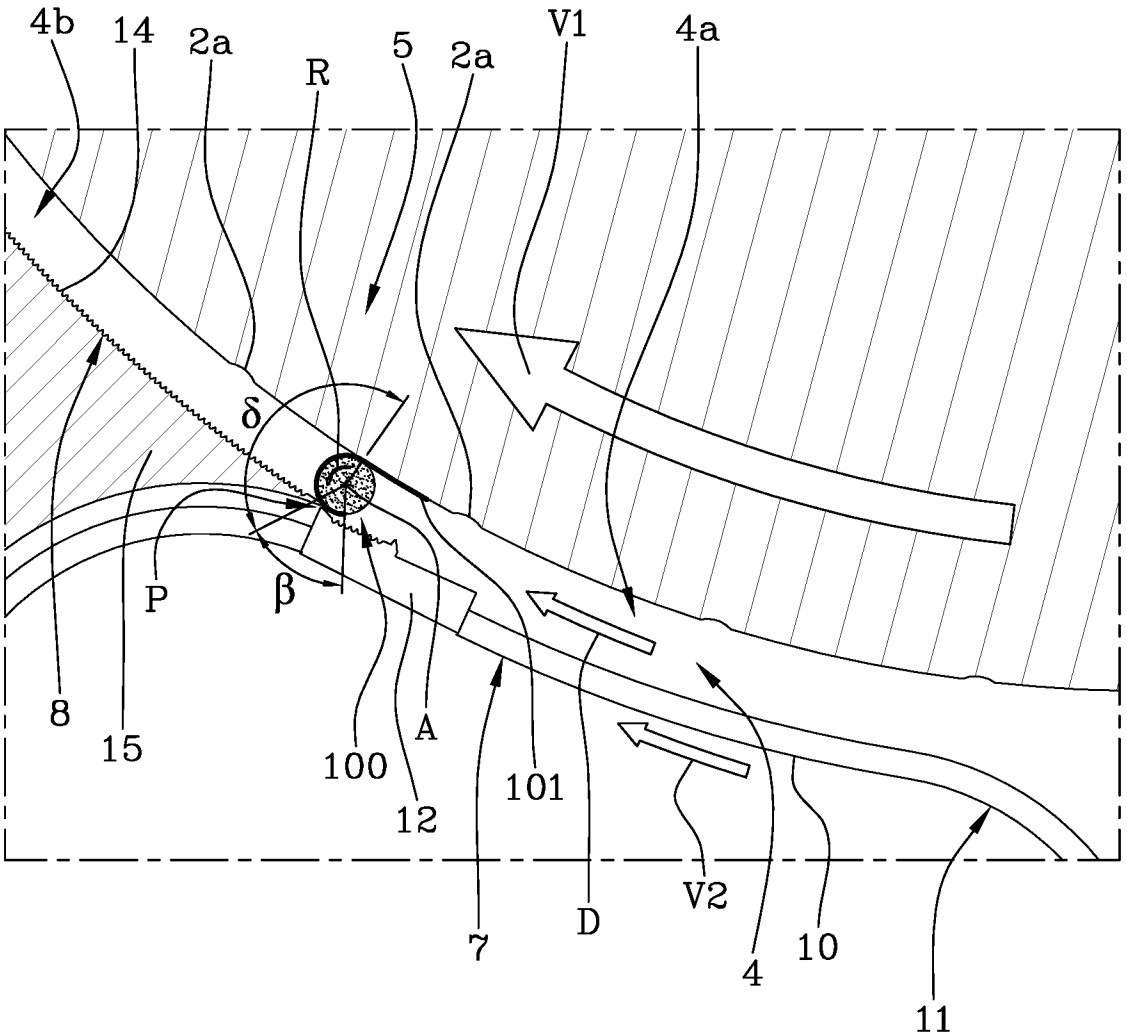

FIG. 2*c* shows a final moment of the infeed rolling step where the group 100 has traversed the infeed stretch 4*a* of the rolling channel 4, causing the patch to be rolled through an infeed rolling angle δ. At this point, the patch 101 has been rolled around the group 100 through a total angle given by the sum of the pre-wrapping angle β and the infeed rolling angle δ. The group 100 is about to pass from the infeed rolling bed 7 to the outfeed rolling bed 8 and thus from the low-speed rolling step to the high-speed rolling step. In passing, therefore, the group 100 undergoes a further acceleration but remains stable because the passage occurs while the group is rotating about its longitudinal axis and has already been wrapped through an angle equal to the sum of the pre-wrapping angle β and the infeed rolling angle δ.

Figure 3:
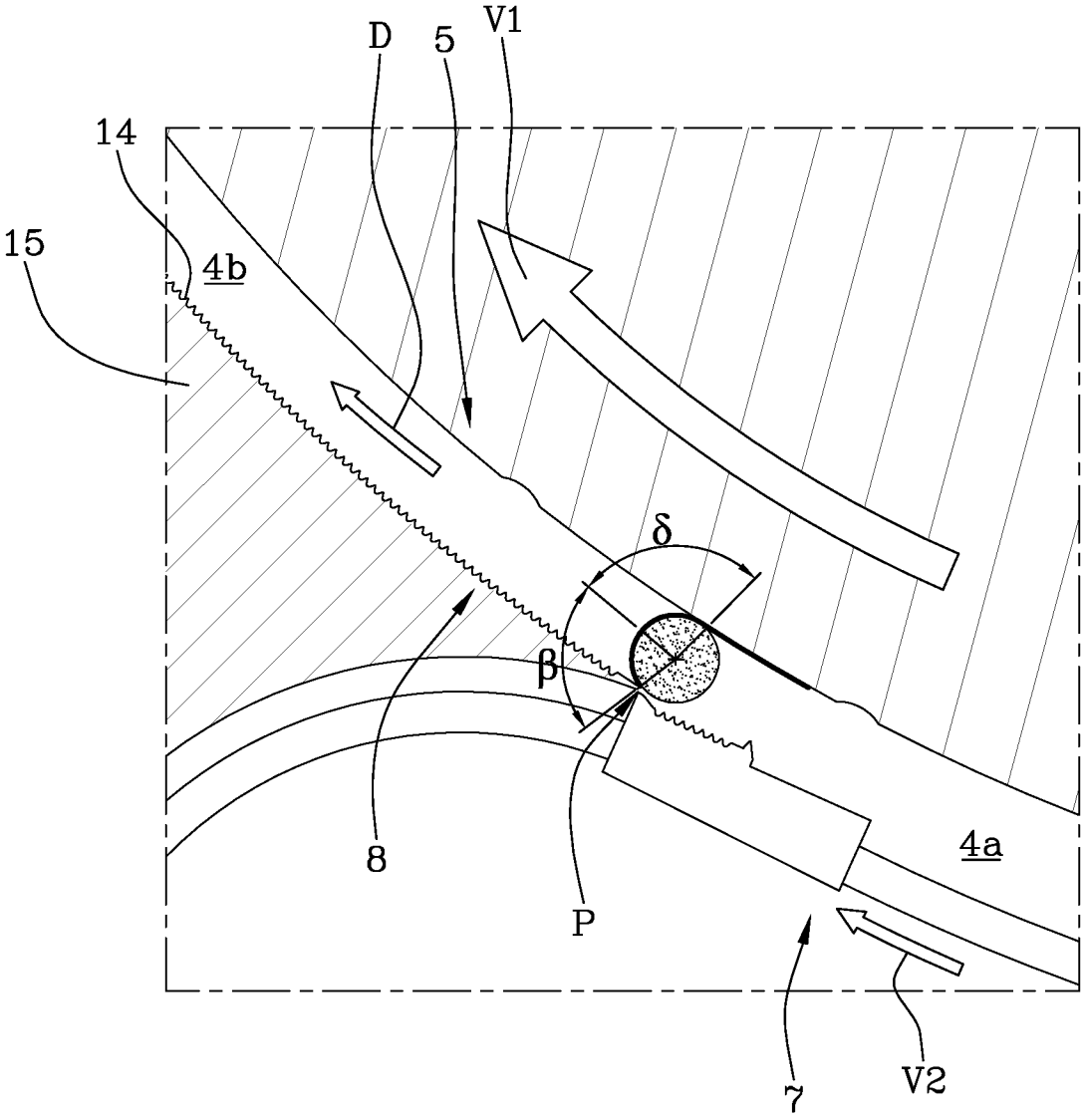
FIG. 3 shows an alternative to what is illustrated in FIG. 2*c;*

FIG. 3 differs from FIG. 2*c* in the size of the infeed rolling angle δ. In FIG. 3, the infeed rolling angle δ is less than a threshold value—for example, 110°—so that passing between the infeed rolling bed 7 and the outfeed rolling bed 8 is performed at the pieces. In other words, the point of contact "P" between the rolling unit 6 and the group 100 in passing between the infeed rolling bed 7 and the outfeed rolling bed 8 is on the pieces. Since the passage between the infeed bed and the outfeed bed occurs on the pieces and not on the patch, any irregularity in the passage does not cause damage to the patch and hence to the finished product.

In FIG. 2*c*, the infeed rolling angle δ is greater than a threshold value so that passing between the infeed rolling bed 7 and the outfeed rolling bed 8 is performed at the patch 101. In other words, the point of contact "P" between the rolling unit 6 and the group 100 in passing between the infeed rolling bed 7 and the outfeed rolling bed 8 is on the patch 101. Since the passage between the infeed bed and the outfeed bed occurs at a large infeed rolling angle δ, the group 100, now half wrapped in the patch, is sufficiently stable to make the passage.

Figure 2D:
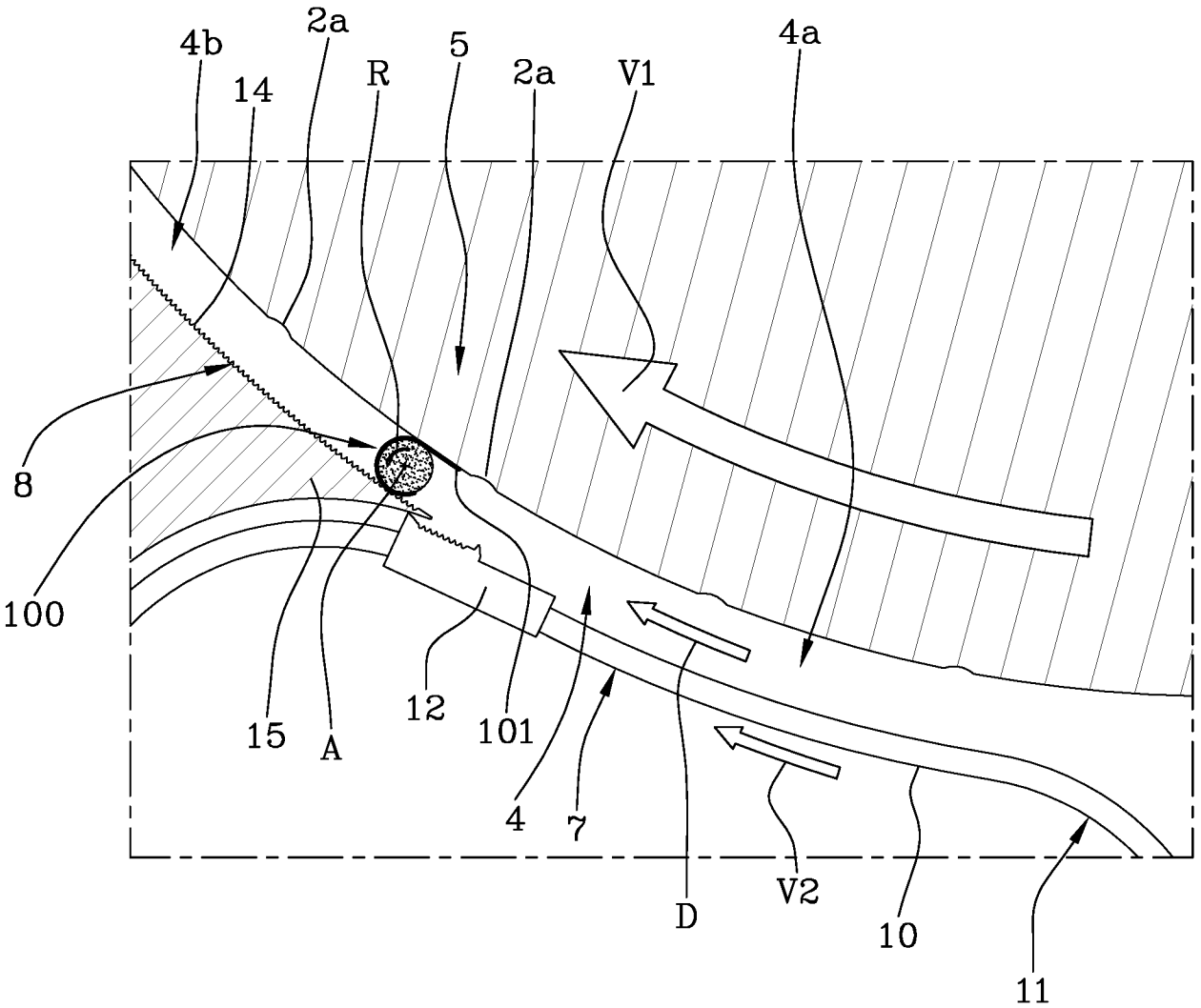

FIG. 2*d* shows an intermediate moment of the outfeed rolling step where the group 100 is traversing the outfeed stretch 4*b* of the rolling channel 4 and, as a result of rolling on the rolling portion 5 and on the outfeed bed 8, the group 100 advances relative to the outfeed bed 8 and withdraws relative to the rolling portion 5 while the patch 101 is wrapped around the group.

Once rolling has been completed, at the exit of the channel 4, the patch 101 is wrapped all the way round the respective group 100 which is thus transferred for further processing.

A method for rolling cigarettes, filter cigarettes or filters is also an object of this invention. The method can be implemented, for example, by a rolling device according to one or more of the embodiments described above. Hereinafter, reference is therefore made to the above described device without thereby limiting the scope of the invention.

The method comprises the steps of overlaying a group 100 of at least two axially aligned pieces of cigarette/filter with a connecting patch 101 for a pre-wrapping angle β and sending the groups 100 and the patches 101 to a rolling channel 4 defined by a rolling portion 5 of a feed conveyor 2 and a rolling unit 6.

The groups 100 and the patches 101, disposed transversely to the travelling direction "D", traverse the rolling channel 4 between the infeed station "I" and the outfeed station "U" and rotate about their longitudinal axes "A", rolling on the rolling portion 5 and on the rolling unit 6.

Advantageously, the infeed rolling bed 7 is moved in the travelling direction "D" independently of the outfeed rolling bed 8 to perform an infeed rolling step and an outfeed rolling step along the rolling channel 4 according to different rolling modes—for example different rolling speeds.

Preferably, the rolling portion 5 is moved along the travelling direction "D" at the first speed V1, while the infeed rolling bed 7 is moved along the travelling direction "D" at the second speed V2 which is lower than the first speed V1, with the same direction.

Preferably, the outfeed rolling bed 8, for example in the form of a tile 15, is held fixed.

In a possible embodiment, the infeed rolling step is performed at low speed and the outfeed rolling step is performed at high speed.

In a possible embodiment, the infeed rolling step is adapted to determine an infeed rolling angle δ which is less than a threshold value—for example, 110°—so that passing between the infeed rolling bed 7 and the outfeed rolling bed 8 is performed at the pieces. Alternatively, the infeed rolling step is adapted to determine an infeed rolling angle δ which is greater than the threshold value so that passing between the infeed rolling bed 7 and the outfeed rolling bed 8 is performed at the patch 101.

The modes at least of the infeed rolling step are adjustable as a function of the properties of the group 100. More specifically, the infeed rolling angle δ and the second speed V2, hence the rolling speed along the infeed stretch 4*a* of the channel 4 are adjustable as a function of the properties of the group 100. Thus, the rolling method according to the invention may comprise the step of adjusting the modes at least of the infeed rolling step as a function of the properties of the group 100. This step preferably comprises the step of adjusting the infeed rolling angle δ and the second speed V2, hence the rolling speed along the infeed stretch 4*a* of the channel 4 as a function of the properties of the group 100.

In the case where the device 1 comprises a rolling conveyor 9 provided with pads 12, the method according to the invention may also comprise the step of controlling the feed conveyor 2 and the rolling conveyor 9 in such a way that the pads 12 are synchronized with the flutes 2*a* and the pad 12, in particular the tooth 13, if provided, meets the respective group 100 at the infeed station "I".

The device 1 and the method described offers numerous advantages. In particular, by dividing the rolling unit into an infeed rolling bed and an outfeed rolling bed, it is possible, by differentiating the rolling modes in the two stretches, to prevent the creasing which may occur during the initial rolling stages.

Combining an infeed rolling conveyor with a fixed outfeed tile allows rolling to be completed in a simple and effective manner.

Furthermore, the device 1 is advantageous because it allows cigarettes of a high-quality standard to be made, considering the high operating speeds at which the device is required to work. It also allows making cigarettes including at least one component made of a hard material, such as charcoal or plastic, which are not subject to deformation. This is possible thanks to the flexible conveyor element 10, when the latter is in the form of an endless tape or belt made of resilient, flexible material, because the flexible conveyor 10 yields to the pressure of the cigarette and does not damage the hard material component of the cigarette.

The invention described above is susceptible of industrial application; it may also be modified and adapted in several ways without thereby departing from the scope of the inventive concept. Moreover, all the details of the invention may be substituted by technically equivalent elements.

For example, in a possible alternative embodiment, the outfeed rolling bed might comprise a further rolling conveyor driven independently of the rolling conveyor 9 to define a movable outfeed bed.

The invention claimed is:

1. A rolling device, comprising:

a feed conveyor configured to transversely feed groups of pieces of cigarette and/or filter and patches for connecting the groups, each group being defined by at least two axially aligned pieces and each patch being positioned tangentially to a group of pieces starting from an end of the group and glued to the group, wherein the feed conveyor is a drum including a horizontal axis and suction flutes disposed on a radially external surface of the drum, each suction flute being configured to receive and retain a group of pieces, a rolling channel extending along an arcuate main direction of extension between an infeed station of the groups and of the respective patches and an outfeed station of the groups after the groups have been wrapped with the respective patches, wherein the rolling channel is delimited, transversely to the main direction of extension, by a rolling portion of an outer surface of the drum on one side, and by a rolling unit on an opposite side, the rolling unit being located at a distance from the rolling portion such as to define a width of the rolling channel which is the same or smaller than a diameter of the groups, the drum being adapted to be set in rotation about the horizontal axis to feed the groups to the rolling channel; wherein the rolling channel is adapted, in a use configuration of the rolling device, to be travelled transversely by each group of pieces which, as the group advances in a travelling direction between an infeed station and an outfeed station of the rolling channel, rolls on the rolling portion and on the rolling unit rotating about a longitudinal axis of the group, wherein the rolling unit comprises an infeed rolling bed and an outfeed rolling bed located in succession along the travelling direction of the rolling channel and defining an infeed stretch and an outfeed stretch of the rolling channel, respectively, adapted to roll each group of pieces by an infeed rolling angle and an outfeed rolling angle, respectively, and wherein the infeed rolling bed is movable along the travelling direction independently of the outfeed rolling bed to produce different rolling modes along the infeed stretch and along the outfeed stretch.

2. The rolling device according to claim 1, wherein the drum is configured to feed the groups and to move the rolling portion along the travelling direction at a first speed, and further comprising a rolling conveyor defining the infeed rolling bed movable at a second speed which is lower than the first speed, with a same direction.

3. The rolling device according to claim 2, wherein the rolling conveyor comprises a flexible endless conveyor element trained around a transmission, the infeed rolling bed being defined at a rolling portion of the flexible conveyor element which faces the rolling portion of the drum.

4. The rolling device according to claim 3, wherein the rolling conveyor comprises a plurality of pads fixed to the flexible conveyor element and defining the infeed roller bed at the rolling portion.

5. The rolling device according to claim 4, wherein each pad comprises a tooth configured to dislodge a group of pieces from a respective flute of the drum.

6. The rolling device according to claim 4, wherein each pad extends along the travelling direction for a rolling length equal to an infeed rolling arc of a group of pieces, corresponding to the infeed rolling angle.

7. The rolling device according to claim 2, wherein the infeed stretch of the rolling channel extends along the travelling direction for an infeed rolling length which is defined as a function of the first speed, the second speed and the infeed rolling angle.

8. The rolling device according to claim 3, wherein the flexible conveyor element comprises three conveyor belts disposed side by side transversely to the travelling direction, defining a central conveyor belt and two perimeter conveyor belts, smaller in width than the central conveyor belt.

9. The rolling device according to claim 8, wherein along the travelling direction, the portion of the perimeter conveyor belts located at the rolling portion of the flexible conveyor element is greater in length than the portion of the central conveyor belt located at the rolling portion of the flexible conveyor element, in such a way that the infeed stretch and the outfeed stretch interpenetrate each other at the central conveyor belt.

10. The rolling device according to claim 3, wherein the flexible conveyor element is operatively connected to a motor to be driven and advanced at the second speed and further comprising a control unit operatively connected with the motor to adjust the second speed as a function at least of the first speed and the infeed rolling angle.

11. The rolling device according to claim 1, wherein the outfeed rolling bed is a fixed bed defined by a wall of a tile.

12. A method for rolling cigarettes, filter cigarettes, and filters comprising the steps of:

overlaying a group of at least two axially aligned pieces of cigarette and/or filter with a connecting patch for a prewrapping angle, directing the group and the patch to a rolling channel having an arcuate main direction of extension and delimited, transversely to the main direction of extension, by a rolling portion of a drum and a rolling unit, wherein the group and the patch are disposed transversely of a travelling direction as the group and the patch travel the rolling channel between an infeed station and an outfeed station of the rolling channel, and the group rolls about a longitudinal axis thereof on the rolling portion and on the rolling unit, wherein an infeed rolling bed of the rolling unit is moved in the travelling direction independently of an outfeed rolling bed of the rolling unit, to perform an infeed rolling step and an outfeed rolling step according to different rolling modes along the rolling channel.

13. The rolling method according to claim 12, wherein the rolling portion is moved along the travelling direction at a first speed, and in that the infeed rolling bed is moved along the travelling direction at a second speed which is lower than the first speed, with a same direction.

14. The rolling method according to claim 13, and further comprising a step of adjusting the rolling modes of the infeed rolling step and a step of adjusting an infeed rolling angle and the second speed, and hence a rolling speed along an infeed rolling stretch of the rolling channel.

15. The rolling method according to claim 12, wherein the outfeed rolling bed of the rolling unit is kept fixed.

16. The rolling method according to claim 12, wherein the infeed rolling step is adapted to determine an infeed rolling angle which is less than 110° so that passing between the infeed rolling bed and the outfeed rolling bed is performed at the pieces.

17. The rolling method according to claim 12, wherein the infeed rolling step is adapted to determine an infeed rolling angle which is greater than 110° so that passing between the infeed rolling bed and the outfeed rolling bed is performed at the patch.

18. The rolling method according to claim 12, wherein the infeed rolling step is performed at a lower speed than the outfeed rolling step.

19. The rolling method according to claim 12, and further comprising a step of moving along the travelling direction a plurality of pads defining the infeed rolling bed and a step of controlling the drum and the infeed rolling bed in such a way that the pads are in phase with flutes of the drum and each pad meets the respective group at the infeed station.

20. A rolling device, comprising:

a feed conveyor configured to transversely feed groups of pieces of cigarette and/or filter and patches for connecting the groups, each group being defined by at least two axially aligned pieces and each patch being positioned tangentially to a group of pieces starting from an end of the group and glued to the group itself, a rolling channel delimited, at one end, by a rolling portion of the feed conveyor, and at the other end, by a rolling unit located at a distance from the rolling portion such as to define a width of the rolling channel which is the same or smaller than a diameter of the groups, wherein the rolling channel is adapted, in a use configuration of the rolling device, to be travelled transversely by each group of pieces which, as the group advances in a travelling direction between an infeed station and an outfeed station of the rolling channel, rolls on the rolling portion and on the rolling unit rotating about a longitudinal axis of the group, wherein the rolling unit comprises an infeed rolling bed and an outfeed rolling bed located in succession along the travelling direction of the rolling channel and defining an infeed stretch and an outfeed stretch of the rolling channel, respectively, adapted to roll each group of pieces by an infeed rolling angle and an outfeed rolling angle, respectively, and wherein the infeed rolling bed is movable along the travelling direction independently of the outfeed rolling bed to produce different rolling modes along the infeed stretch and along the outfeed stretch, a rolling conveyor defining the infeed rolling bed, wherein the rolling conveyor comprises a flexible endless conveyor element trained around a transmission, the infeed rolling bed being defined at a rolling portion of the flexible conveyor element which faces the rolling portion of the feed conveyor, wherein the rolling conveyor comprises a plurality of pads fixed to the flexible conveyor element and defining the infeed roller bed at the rolling portion.

* * * * *